US005542455A

United States Patent [19]

Ostermayer et al.

[11] Patent Number: 5,542,455

[45] **Date of Patent: *Aug. 6, 1996**

[54] PAPERMAKING FABRIC HAVING DIAGONAL ROWS OF POCKETS SEPARATED BY DIAGONAL ROWS OF STRIPS HAVING A CO-PLANAR SURFACE

[75] Inventors: Volker Ostermayer, Greenville; Scott Quigley, Simpsonville, both of S.C.

[73] Assignee: Wangner Systems Corp., Greenville, S.C.

[ * ] Notice: The term of this patent shall not extend beyond the expiration date of Pat. No. 5,456,293.

[21] Appl. No.: 387,436

[22] Filed: Feb. 13, 1995

Related U.S. Application Data

[63] Continuation-in-part of Ser. No. 283,533, Aug. 1, 1994, Pat. No. 5,456,293.

[51] Int. Cl.[6] ..... D03D 15/00

[52] U.S. Cl. ..... 139/383 A; 26/28

[58] Field of Search ..... 139/383 A; 162/902, 162/903; 26/28; 428/257

[56] References Cited

U.S. PATENT DOCUMENTS

| | | | |
|---|---|---|---|
| 3,573,164 | 3/1971 | Friedberg et al. | 139/383 A |
| 3,905,863 | 9/1975 | Ayers | 139/383 A |
| 3,974,025 | 8/1976 | Ayers . | |
| 4,191,609 | 3/1980 | Trokhan . | |
| 4,239,065 | 12/1980 | Trokhan . | |
| 4,909,284 | 9/1990 | Kositzke . | |
| 5,228,482 | 7/1993 | Fleischer . | |

*Primary Examiner*—Andy Falik

*Attorney, Agent, or Firm*—Henry S. Jaudon; Cort Flint

[57] ABSTRACT

A woven fabric for use in papermaking machines and particularly with through air drying machines. The fabric comprises a paper support surface having spaced diagonal rows pockets which are effective to create diagonal rows of uncompressed paper forming fibers over the surface of paper formed on the papermaking machine. The rows of pockets are separated by diagonal strips of support surface arranged along substantially a single plane. The diagonal strips provide support areas over the width of the paper forming fibers which firmly secure the fiber sheet with the papermaking fabric during paper forming. The strips also produce diagonal rows of compressed paper forming fibers which provide for a more stable paper product.

20 Claims, 3 Drawing Sheets

PAPERMAKING FABRIC HAVING DIAGONAL ROWS OF POCKETS SEPARATED BY DIAGONAL ROWS OF STRIPS HAVING A CO-PLANAR SURFACE

This is a continuation-in-part of application Ser. No. 08/283,533 filed on 08/01/94, U.S. Pat. No. 5,456,293.

BACKGROUND OF THE INVENTION

This invention relates to papermaking fabrics particularly drying and imprinting fabrics for use with through air drying machines. The fabric of the invention possesses a support surface which, due to its woven structure, and sanding, provides a large support surface area for the paper forming fibers to adhere to during processing while at the same time providing sufficient areas in which the fibers remain uncompressed producing a paper product with high bulk, superior absorptive qualities, a soft texture and improved strength.

Numerous attempts have been made to provide a papermaking fabric capable of producing a paper product with increased bulk which provides for a softer and more absorbent product. Combined with increased bulk, the product must include improved flexibility while maintaining acceptable or improved strength. Early efforts to provide such a papermaking fabric are disclosed in U.S. Pat. No. 3,301,746 which discloses the use of square, diagonal, twill and semi-twill weaves. Another early effort is disclosed in U.S. Pat. No. 3,974,025 which discloses using the back surfaces of heretofore known papermaking fabrics. Another development in papermaking fabrics is disclosed in U.S. Pat. No. 4,239,065 to Trokham. This patent discloses a papermaker's fabric having a forming surface comprised of successive diagonal rows of co-planar cross-overs forming individual pockets across and along the length of the fabric. U.S. Pat. No. 5,228,482 discloses a paper forming fabric similar to that of Trokham. Here the cross-overs forming the successive rows of pockets are multiplanar. U.S. Pat. Nos. 4,239,065 and 5,228,482 disclose papermaking fabrics having successive diagonal row of individual pockets. These rows of pockets form the paper support surface of the fabric as there are no intervening support surface areas i.e. strips, formed between them.

These earlier patents disclose papermaking fabrics which produce paper having successive rows of pillows or uncompressed areas surrounded by lineaments of compressed areas. The rows of pillows and lineaments are arranged to extend transverse or diagonally of the paper.

Accordingly, an object of the instant invention is to provide a papermaking fabric capable of producing paper of high bulk and increased strength.

Another object of the invention is to provide a papermaking fabric capable of producing paper of increased softness and absorbability.

A further object of the invention is to provide a paper imprinting fabric which produces paper having continuous compressed diagonal strips arranged over its surface.

A further object of the invention is to provide a papermaking fabric having a product support surface which produces uniform fiber orientation.

A further object of the invention is to provide a product support surface which provides increased fiber adhesion. A further objects of the invention is to provide a papermaking fabric having a product support surface comprised of diagonal rows of pockets separated by diagonal strips or planar support surface areas.

A further object of the invention is to provide a papermaking fabric which allows increased heat transfer.

A further object of the invention is to provide a papermaking fabric which produces a paper product having both diagonal and transverse rows of pillows.

SUMMARY OF THE INVENTION

The instant invention is directed to a woven fabric for use on papermaking machines having a support surface and a running surface. The fabric is formed with MD (machine direction) synthetic filaments arranged in generally parallel relationship and first and second groups of CMD (cross-machine direction) synthetic filaments arranged in parallel relationship transversely of the MD filaments. The support surface comprises first rows of pockets diagonally arranged in spaced fashion along the length of the fabric and defining diagonal strips over the support surface between adjacent ones of the rows of pockets. The MD filaments are woven with the first and second groups of CMD filaments to form a first set of MD support surface cross-overs extending along a first plane, a second set of MD support surface cross-overs extending along a second plane below the first plane, and a third set of MD support surface cross-overs extending along a third plane below the second plane. The first group of CMD filaments are woven with the MD filaments to form a first set of CMD support surface cross-overs which extend along the first plane. The second group of CMD filaments are woven with said MD filaments to form a second set of CMD support surface cross-overs which extend along the second plane.

The support surface is ground or sanded so that the first set of MD cross-overs and the first set of CMD cross-overs lie along the second plane. In this condition, the second set of CMD cross-overs along with certain of the first set of MD cross-overs define pockets in first rows along the length of the fabric, and the first set of CMD cross-overs along with the first and second set of MD cross-overs form the support surface strips between the rows of pockets along the length of the fabric. This structure provides the support surface with expanded contact area for supporting paper forming fibers.

The filaments forming the fabric are synthetic monofilaments which may be formed of polyester, polyamide, polyaryletherketones or polyester, polyamide blends. The second group of CMD filaments forming the second set of CMD cross-overs comprise filaments having a larger diameter than the first group of CMD filaments forming the first set of CMD cross-overs. The MD filaments are normally of a lesser diameter than the second group of CMD filaments forming the second set of CMD cross-overs and of a greater diameter than the first group of CMD filaments forming the first set of CMD cross-overs.

The larger diameter second group of CMD filaments are arranged in alternating manner with the smaller diameter first group of CMD filaments throughout the weave pattern.

A dryer fabric for drying paper forming fibers, having machine direction (MD) yarns and cross-machine direction (CMD) yarns which extend in the corresponding machine and cross machine directions on the papermaking machine. The fabric comprises a support surface including diagonal rows of pockets arranged in space fashion along the length of the fabric. The diagonal rows of pockets define strips of substantially monoplanar support surface between the adjacent rows of pockets along the length of fabric.

The pockets are circumscribed by a first set of cross-overs of the CMD yarns and selected ones of a first set of cross-overs of the MD yarns which have top surfaces arranged along a first plane. The lower pocket portion is defined by a second set of cross-overs of the MD yarns arranged with their top surfaces along a second plane which is disposed below the first plane. The support surface strips are defined by the first set of cross-overs of the CMD yarns and the first set of cross-overs of said MD yarns having top surfaces arranged along the first plane. This arrangement of strips provides an expanded contact area over the support surface which provides better adhesion and control of the paper forming fibers during the drying operation while the pockets allow sufficient numbers of the paper forming fibers to remain uncompressed. The combination provides a support surface which produces paper having soft texture, bulk and high strength.

A plurality of the top surfaces of the first set of MD and CMD cross-overs extending along the first plane are ground to present flat surface areas while other of the top surfaces of the MD and CMD cross-overs extending along the first plane present convex surface areas.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
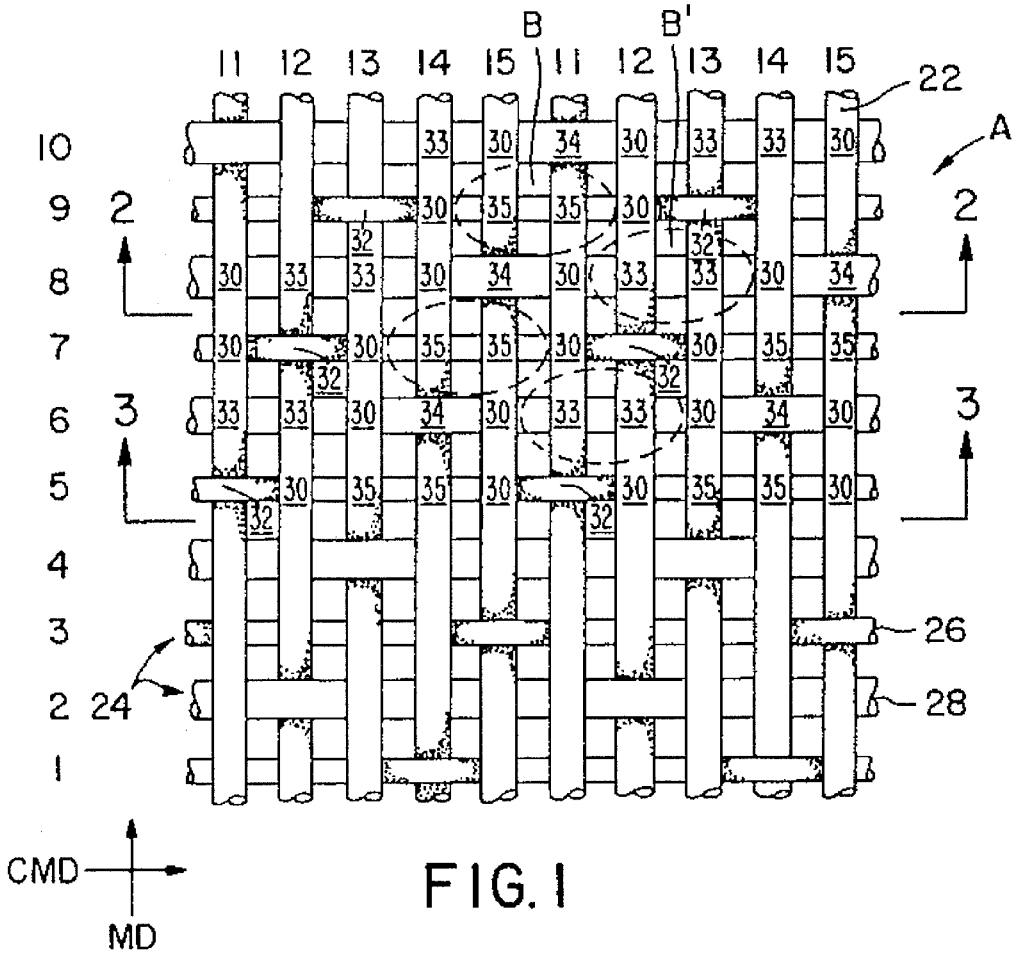
FIG. 1 is a top view of a weft repeat of the weave pattern of the fabric of the invention formed with alternately arranged large and small diameter weft yarns (CMD).

FIG. 1 is a sectional top view which shows support surface A in a single repeat in the weft direction and two repeats in the warp direction of the weave pattern of the preferred embodiment of the papermaking fabric of the invention. The weave pattern is a modified Atlas which consist of ten weft yarns which generally extend in the cross machine direction (CMD) and five warp yarns which generally extend in the machine direction (MD) per pattern repeat. The warp yarns of the pattern repeat are numbered 11–15 and are identified with numeral 22 while the weft yarns are numbered 1–10 and are identified with the numeral 24.

Weft yarns 24 comprise small diameter yarns 26 and large diameter yarns 28. These yarns are arranged throughout the weave pattern and along the length of the fabric in alternating manner as shown in FIG. 1. Large diameter weft yarns 28 normally have a diameter of between 0.41 and 0.49 mm with the preferred size being 0.44 mm. Small diameter weft yarns 26 normally have a diameter of between 0.26 and 0.34 mm with the preferred size being 0.30 mm. Weft yarns 24 preferably are formed of synthetic monofilaments having a circular cross section. It is within the realm of the invention that the weft yarns may also have shaped cross sections such as rectangular or oval and that all weft yarns may be of one or a plurality of cross sectional shapes. Alternatively shaped and circular cross sectional weft yarns could be utilized in an arranged sequence. The preferred synthetic materials forming the weft yarns are of polyamide, polyester, polyaryletherketones or a blend of any of the above.

Warp yarns 22 are preferable formed of synthetic monofilaments of a circular uniform diameter which normally ranges from between 0.30 and 0.38 mm. The preferred diameter is 0.34 mm. While it is preferred that the warp yarns are formed of monofilaments of circular cross section it is contemplated that shaped monofilaments as described above could be used. The warp yarns are preferably formed of the same synthetic materials as indicated for the weft yarns.

Again referring to FIG. 1, it can be seen that weft yarns 1 and 6 weave under warp yarns 11–13, over warp yarn 14 and under warp yarn 15. Weft yarns 2 and 7 weave under warp yarn 11, over warp yarn 12 and under warp yarns 13–15. Weft yarns 3 and 8 weave under warp yarns 11–14 and over warp yarn 15. Weft yarns 4 and 9 weave under warp yarns 11 and 12, over warp yarn 13 and under warp yarns 14–15. Weft yarns 5 and 10 weave over warp yarn 11 and under warp yarns 12–15. While the warp, weft relationship between weft yarns 1, 6; 2, 7; 3, 8; 4, 9; and 5, 10 is identical the resulting surface configuration differs through the ten pick repeat because the odd numbered weft yarns identified with numeral 26 are smaller in diameter than the even numbered weft yarns identified with number 28. As a result, it requires ten weft yarns and five warp yarns to produce a complete pattern repeat.

Figure 2:
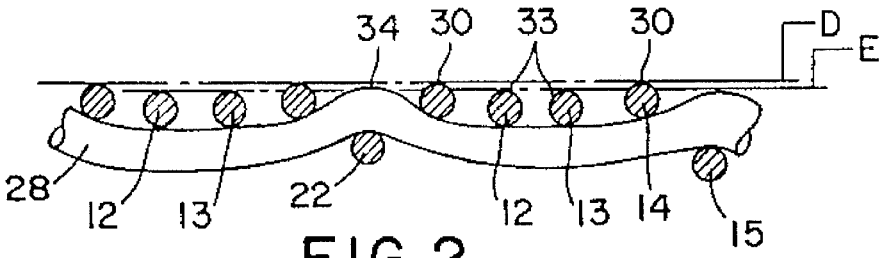
FIG. 2 is a section view taken along line 2—2 of FIG. 1 showing the relationship of the warp yarns (MD) and the large diameter CMD yarn.

Turning now to FIG. 2, taken along line 2—2 of FIG. 1, it can be seen that as weft yarn 8 of the large diameter weft yarns 28 traverses the smaller diameter warp yarns 22 there is a minimum amount of crimp produced in the weft yarn. By varying the size ratio between the weft yarns 28 and warp yarns 22, the degree of crimp placed in the large weft yarns can be controlled. The preferred diameter of 0.44 mm for weft yarns 28 interweaving with warp yarns of 0.30 mm diameter provides a minimal crimp which leaves the upper or cross-over surfaces 34 of weft yarns 28 lying along a lower or sub-support surface substantially horizontal plane E. Also, it can be seen that the upper surfaces of cross-overs 33 of warp yarns 12 and 13 where they cross over weft 28, also are positioned to lie along the sub-support surface or lower substantially horizontal plane E. The upper surfaces or support surface cross-over 30 of warp yarns 11 and 14 are elevated to extend along a common upper or support surface substantially horizontal plane D where they cross over weft yarns 28. These cross-over positions are brought about primarily because of the high resistance to bending possessed by the large diameter weft yarns 28 when pressed by the smaller diameter warp yarns 22.

Figure 3:
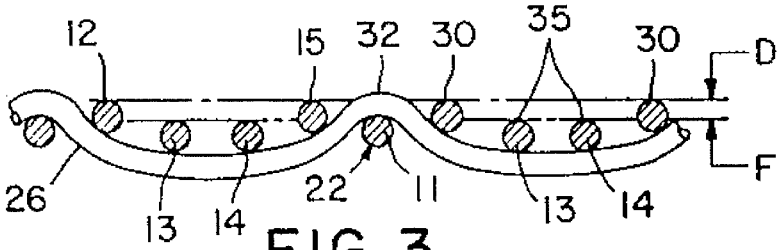
FIG. 3 is a sectional view taken along line 3—3 of FIG. 1 showing the relationship of the warp yarns (MD) and the small diameter CMD yarn.

Turning now to FIG. 3, which is taken along line 3—3 of FIG. 1, the configuration of weft yarn 5 of smaller weft yarns 26 can be seen as it traverses through warp yarns 22. Here the upper surfaces or cross-over surfaces 30 of warp yarns 11 and 15 can be seen as extending along the common upper or support surface plane D as they cross over weft yarn 3 of weft yarns 26 while the upper surfaces or cross-over surfaces 35 of warp yarns 13 and 14 where they cross over weft yarn 26 are aligned along a second sub-support surface plane F which lies below the sub support surface plane E of the sub support surface cross-overs 33. The positioning of cross-overs 30 and 35 is controlled by weft yarns 26, which are of a diameter smaller than that of both weft yarn 28 and warp yarn 22. Because of this smaller diameter, these yarns have a low resistance to bending and are crimped by the larger diameter warp yarn as they cross thereover so that their upper surfaces at cross-over 32 with warp yarn 11 of warp yarns 22 are raised or brought up to lie also along upper plane D and aligned with the cross-over surfaces 30 of warp yarns 12 and 15. The support surfaces of cross-overs 35 of warp yarns 12, 13 as they pass over weft yarn 3 of weft yarns 26 are aligned with a second sub-support surface plane F which plane is lower than sub-support surface plane E. Again, the larger warp yarns 22 force the smaller weft yarn 26 downward as they tend to maintain their position.

Returning to FIG. 1, it can be seen that support surface cross-overs 30 of warp yarns 22 along with sub-support surface cross-overs 34 of weft yarns 28 form picket defining lineaments around sub-support surface cross-overs 35, of warp yarns 22 defining a series of pockets B. The series of pockets B are arranged in spaced diagonal rows along the length of the fabric. Also, support surface cross-overs 30 along with support surface cross-overs 32 of weft yarns 26 form lineaments about sub-support surface cross-overs 33 defining pockets $B^1$. These pockets are formed along diagonal lines arranged in alternating fashion with the diagonal lines along which pockets B are formed.

Support surface A as shown in FIG. 1 provides a contact area of about 26% for supporting the paper forming fibers during drying. It has been found that an improved product can be produced by increasing the contact area to somewhere in the range of 43%. This larger contact area provides for increased heat transfer between the drying drum and the paper forming fibers and also provides for better adhesion of the fibers with the dryer drum during drying.

In order to transform support surface A of the fabric shown in FIG. 1 to satisfy these requirements the support surface is subjected to sanding or grinding.

Figure 4:
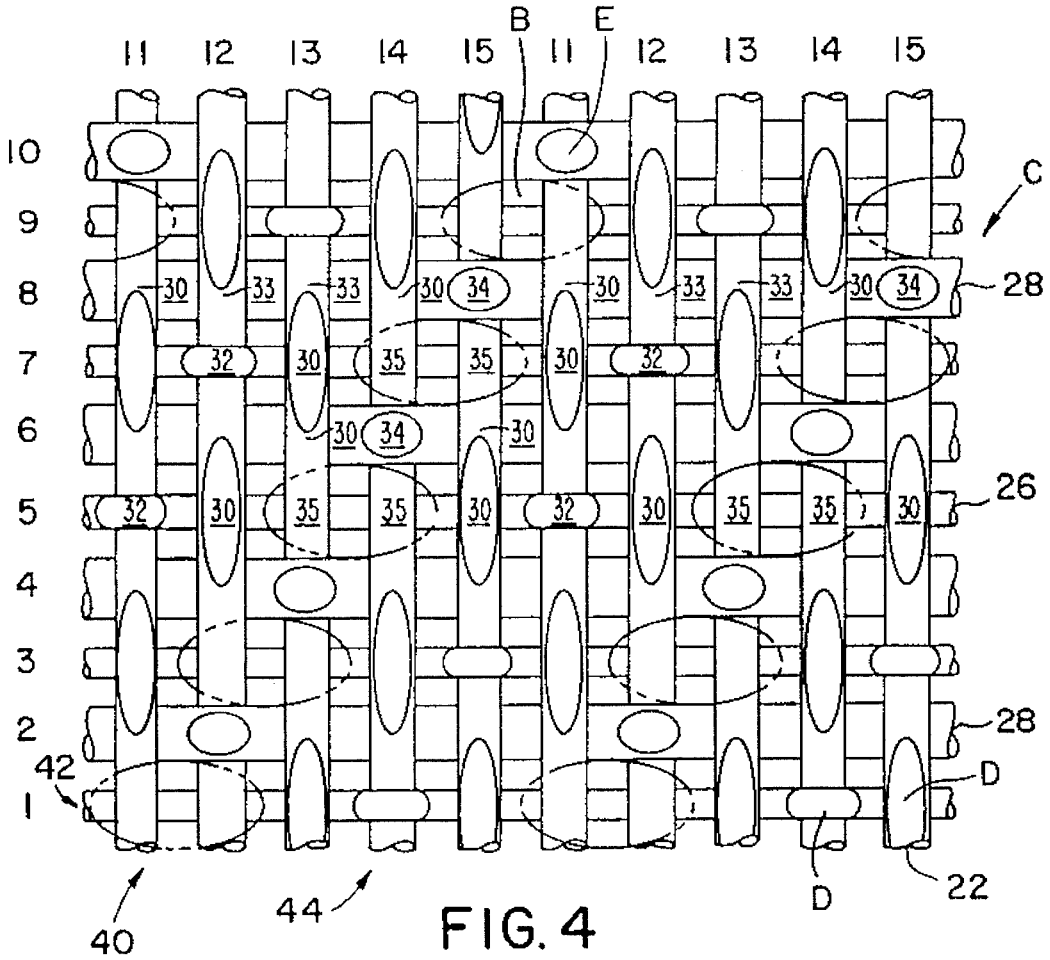
FIG. 4 is a top view of the fabric similar to FIG. 1 with the support surface sanded according to the invention.

Crossovers 30 of warp yarns 22 along with cross-overs 32 of weft yarns 26 are sanded down approximately 0.2 mm lowering their support surfaces to be substantially aligned with sub-support surface plane E. The sanding produces flat or planar support surface areas along plane D. Crossovers 34 of weft yarns 28 may also be sanded to produce flat or planar support surface areas along plane E, however, sanding here is to a lesser degree and in some instances is not necessary. By providing flat support surface areas along planes D, E the area of contact is increased approximately 17% bringing the contact area for support surface C to around 43%. Cross-overs 35 which extend along the second sub-support surface plane F remain below the plane of sanding and below the support surface now formed along plane E to form lower surfaces of pockets B. As shown in FIG. 4, lineaments formed by sanded cross-overs 30, 34 which define pockets B along diagonal lines or rows 40 along the length of the fabric and also along lines or rows 42 which extend transversely of the fabric.

Strips 44 which are defined by cross-overs 30, 32 and 33 are arranged intermediate diagonal rows 40 of pockets B and present a support surface which is substantially mono-planar. Strips 44 provide increased support surface area to better control the paper forming fibers during drying and also provide for increased heat transfer which promotes more complete and uniform drying.

Figure 5:
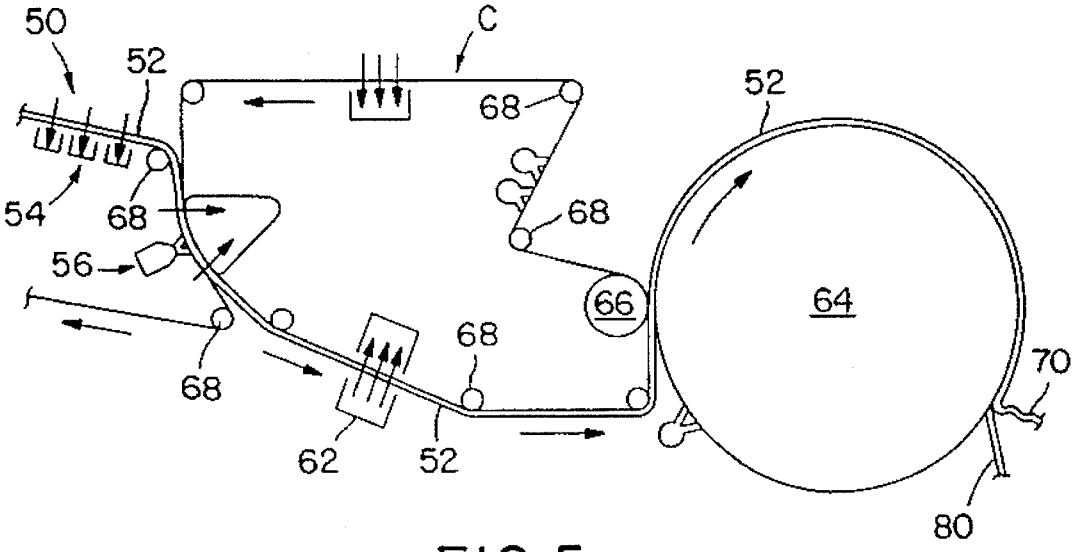
FIG. 5 is a side view of the fabric of the invention in use with a through air drying system.

Turning now to FIG. 5, there is shown a sectional schematic view of a papermaking machine of the type utilizing the drying and embossing fabric of the invention for the manufacture of embossed paper. The arrangement shown includes a forming fabric 50 which carries the paper forming fibers 52 past de-watering vacuum boxes 54 to the transferring device. Transfer device 56 includes the usual air jet and vacuum box. Here the paper forming fibers 52 are transferred onto support surface C of the drying and embossing fabric of the invention. The fibers are moved through pre-dryer 62 and into engagement with dryer drum 64. Pressure roll 66 forces support surface C and fibers 52 against dryer drum 64.

The papermaking machine includes idler pulleys 68 which circulate forming fabric 50 and the drying and embossing fabric through the machine. This apparatus and its functions are well known and are disclosed in U.S. Pat. No. 3,301,746.

As pressure roll 66 presses support surface C carrying the paper forming fibers 52 against Yankee drum 64 the support surface embosses the upper surface of the paper being formed by compressing certain of the paper forming fibers and leaving uncompressed others of the paper forming fibers creating areas of compressed and uncompressed fibers over the surface of the paper as earlier discussed. As drum 64 carries paper forming fibers 52 toward creping or doctor blade 80 the final drying is carried out. Doctor blade 80 removes a paper sheet 70 at a rate to allow a residual crimp or crepe of about 30%. Crepe lines which extend transversely of the paper sheet are usual with this drying apparatus.

Pockets B arranged along diagonal rows 40 and transverse rows 42 create the areas of uncompressed fibers over the surface of the paper sheet. The mono-plane support surface area formed along strips 44 separate the rows of uncompressed fibers with strips of compressed fibers.

Figure 6:
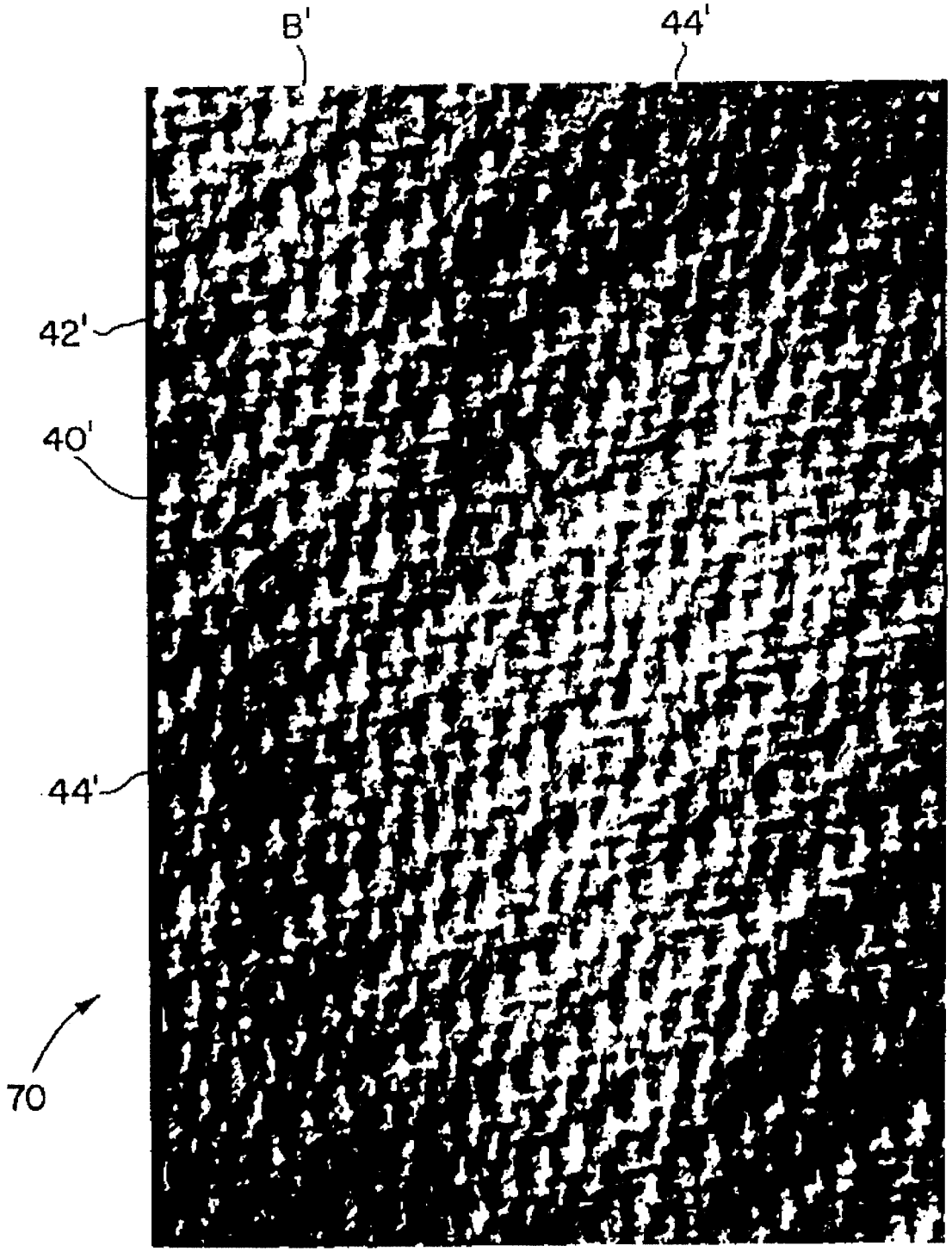
FIG. 6 is a top view of the sculptured paper product produced by the papermaking fabric of the invention.

FIG. 6 shows the outer surface of paper sheet 70 formed with the embossing fabric of the invention. Diagonal rows 40' of pillows B' are formed by pockets B of diagonal rows 40 and can be seen extending along the length of the paper. Pillows B' can also be seen extending transversely of the paper sheet as indicated at 42'. Rows 40' are separated by compressed strips 44' which are formed by the mono-planar support surface of diagonal strips 44.

Paper sheet 70 shown in FIG. 6 possesses high strength characteristics, a soft texture or feel and has high absorptive characteristics. Also, the sculptured configuration shown is pleasing to the eye.

While a preferred embodiment of the invention has been described using specific terms, such description is for illustrative purposes only, and it is to be understood that changes and variations may be made without departing from the spirit or scope of the following claims.

What is claimed is:

1. A woven fabric for use on papermaking machines having a support surface and a running surface, said fabric having MD (machine direction) synthetic filaments arranged in generally parallel relationship, a first group of CMD (cross-machine direction) synthetic filaments and a second group of CMD synthetic filaments arranged in parallel relationship and transversely of said MD filaments, wherein:

said support surface comprises rows of pockets diagonally arranged in spaced fashion along the length of the fabric, and diagonal strips defined over said support surface between adjacent diagonal rows of said pockets;

said MD filaments being woven with said first and second groups of CMD filaments to form a first set of MD cross-overs extending along a first plane over said support surface, a second set of MD cross-overs extending along a second plane over said support surface, said second plane being spaced below said first plane, and a third set of MD cross-overs extending along a third plane over said support surface, said third plane being spaced below said second plane;

said first group of CMD filaments being woven with said MD filaments to form a first set of CMD cross-overs which extend along said first plane over said support surface;

said second group of CMD filaments being woven with said MD filaments to form a second set of CMD cross-overs which extend along said second plane over said support surface;

said cross-overs of said first set of MD cross-overs being ground to define ground planar support surfaces cross-overs which extend along said second plane;

said first set of CMD cross-overs being ground to define planar support surfaces which extend along said second plane;

cross-overs of said second set of CMD cross-overs along with certain of said cross-overs of said first set of MD cross-overs define said pockets in said first rows along the length of said fabric, and cross-overs of said first set of CMD cross-overs along with cross-overs of said first and second set of MD cross-overs form said support surface strips along the length of said fabric providing said support surface with expanded contact area for supporting paper forming fibers.

2. The fabric of claim 1 wherein said filaments are synthetic monofilaments.

3. The fabric of claim 2 wherein said monofilaments are comprised of at least one of polyester, polyamide, polyaryletherketones and polyester, polyamide blends.

4. The fabric of claim 1 wherein said second group of CMD filaments forming said cross-overs of said second set of CMD cross-overs comprise filaments having a larger diameter than said first group of CMD filaments forming said cross-overs of said first set of CMD cross-overs.

5. The fabric of claim 4 wherein said MD filaments are of a lesser diameter than said second group of CMD filaments forming said second set of support surface cross-overs and of a greater diameter than said first group of CMD filaments forming said first sets of support surface cross-overs.

6. The fabric of claim 4 wherein said first group of CMD filaments forming said first set of support surface cross-overs have a diameter of between 0.26 and 0.34 mm and said second group of CMD filaments forming said second set of support surface cross-overs have a diameter of between 0.41 and 0.49 mm.

7. The fabric of claim 4 wherein said first group of CMD filaments forming said first set of support surface cross-overs are 0.30 mm in diameter and said second group of CMD filaments forming said second set of support surface cross-overs are 0.45 mm in diameter.

8. The fabric of claim 4, wherein said larger diameter second group of CMD filaments are arranged in alternating manner with said smaller diameter first group of CMD filaments throughout the weave pattern.

9. The fabric of claim 2 wherein said MD direction filaments are uniform in diameter.

10. The fabric of claim 2 wherein at least one of said groups of said CMD and said MD direction filaments have a circular cross section.

11. The fabric of claim 2 wherein at least one of said groups of said first and second CMD and MD direction filaments have a shaped cross section.

12. The fabric of claim 2 wherein said MD direction filaments have a diameter of between 0.30 and 0.38 mm.

13. The fabric of claim 1 wherein said weave comprises a five MD filament and a ten CMD filament repeating pattern.

14. The fabric of claim 1 wherein said MD filaments passing over said second group of CMD filaments form support surface cross-overs of said first and second set of MD cross-overs which lie along said first and second planes.

15. The fabric of claim 1 where in said MD filaments passing over said first CMD filaments form support surface MD cross-overs of said second and third set of MD cross-overs which lie along said second and third planes.

16. A dryer fabric for drying paper forming fibers, said fabric being woven from machine direction (MD) yarns and cross-machine direction (CMD) yarns which extend in the corresponding machine and cross machine directions in which the fabric runs on a papermaking machine, said fabric comprising:

a support surface including diagonal rows of pockets arranged in space fashion along the length of the fabric, said diagonal rows of pockets defining strips of said support surface between adjacent rows of said pockets extending diagonally along the length of said fabric;

said pockets being circumscribed by a first set of CMD cross-overs of said CMD yarns and a first set of MD cross-overs of said MD yarns, and said CMD cross-overs and said MD cross-overs having top surfaces arranged along a first plane;

a lower pocket portion defined by a second set of MD cross-overs of said MD yarns having top surfaces along a second plane disposed below said first plane; and said support surface strips being defined by a second set of CMD cross-overs of said CMD yarns and said first set of MD cross-overs, and second set of CMD cross-overs and MD cross-overs having top surfaces arranged along said first plane; whereby, an expanded contact area is provided over said support surface by said support surface strips which provides better adhesion and control of said paper forming fibers during drying while said pockets allow sufficient numbers of said paper forming fibers to remain uncompressed, the combination providing the formation of paper having soft texture, bulk and strength.

17. The fabric of claim 16 further comprising a plurality of said top surfaces of said first set of MD and CMD extending along said first plane are ground to present flat surface areas while other of said top surfaces of said MD and CMD cross-overs extending along said first plane present convex surface areas.

18. The fabric of claim 16 wherein said dryer fabric is woven in a 10 pick modified atlas weave pattern.

19. The fabric of claim 16 wherein said pockets are arranged to extend transversely across said support surface in spaced parallel rows.

20. A method of forming a papermaking fabric for use on papermaking machines having an imprint forming support surface, said fabric being formed of MD (machine direction) filaments woven with a first group of CMD (cross machine direction) filaments having a first diameter and a second group of CMD filaments having a greater diameter, said method comprising:

arranging filaments of said first and second groups of CMD filaments in parallel relationship and in alternating fashion along the length of said fabric, interlacing said MD filaments over and under said first and second groups of CMD filaments in a prescribed weave which includes;

forming a first set of MD cross-overs which extend along a first plane over said support surface;

forming a second set of MD direction cross-overs along a second plane which is below said first plane over said support surface;

forming a third set of MD cross-overs which extend along a third plane below said second plane over said support surface;

forming a first set of CMD cross-overs which extend along said first plane;

forming a second set of CMD cross-overs which extend along said second plane;

grinding said first set of CMD cross-overs to form planar upper surfaces which extend along said second plane;

grinding said first set of MD cross-overs to define a planar upper surfaces which extend along said second plane; whereby a fabric having a support surface with spaced diagonal rows of pockets separated by rows of planar strips arranged over its length is formed with said pockets comprising MD cross-overs of said third set of MD cross-overs circumscribed by MD cross-overs of said first set and CMD cross-overs of said second set, and said diagonal rows of strips comprising cross-overs of said first set of CMD cross-overs and said first and second sets of MD cross-overs.

* * * * *